US006772930B2

(12) United States Patent
Ayres

(10) Patent No.: US 6,772,930 B2
(45) Date of Patent: Aug. 10, 2004

(54) STAPLER FOR FLARING STAPLE

(75) Inventor: Donald Ayres, Northbrook, IL (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/411,898

(22) Filed: Apr. 11, 2003

(65) Prior Publication Data

US 2004/0084498 A1 May 6, 2004

Related U.S. Application Data

(60) Provisional application No. 60/423,066, filed on Nov. 1, 2002.

(51) Int. Cl.[7] ..... B25C 7/00

(52) U.S. Cl. ..... 227/83; 227/88; 227/123; 227/155

(58) Field of Search ..... 227/83, 123, 155, 227/82, 88, 89, 131

(56) References Cited

U.S. PATENT DOCUMENTS

| | | | | | |
|---|---|---|---|---|---|
| 2,420,258 | A | | 5/1947 | Maynard | |
| 3,152,335 | A | * | 10/1964 | Wandel et al. | 227/83 |
| 3,291,357 | A | * | 12/1966 | Ruskin | 227/83 |
| 3,417,908 | A | | 12/1968 | Treatman | |
| 3,807,619 | A | | 4/1974 | Doyle | |
| 4,013,206 | A | * | 3/1977 | Lemos | 227/83 |
| 4,340,331 | A | * | 7/1982 | Savino | 411/457 |
| 4,574,992 | A | | 3/1986 | Holman | |
| 6,164,513 | A | * | 12/2000 | Yoshie | 227/155 |
| 6,193,126 | B1 | * | 2/2001 | Lee | 227/83 |

* cited by examiner

*Primary Examiner*—Scott A. Smith
(74) *Attorney, Agent, or Firm*—Wood, Herron & Evans, L.L.P.

(57) ABSTRACT

A stapler for clinching materials together with a generally U-shaped staple. The stapler has an anvil with spaced-apart wedges disposed adjacent a backing plate, and the spaced-apart wedges have respective chamfers that contact legs of the staple and guide the legs away from each other. A driver blade is movable between the spaced apart wedges and pushes against a staple crown. As an actuator pushes the driver blade between the wedges, the staple is being pushed over the wedges. The actuator retracts the driver blade from between the spaced-apart wedges substantially independent of a biasing force pushing the spaced apart wedges against the backing plate.

9 Claims, 3 Drawing Sheets

STAPLER FOR FLARING STAPLE

This application claims the benefit of U.S. Provisional Application Ser. No. 60/423,066, filed on Nov. 1, 2002.

FIELD OF THE INVENTION

This invention relates generally to a stapler and, more particularly, to an improved stapler having an anvil structure that joins materials by flaring the legs of the staple outward and away from each other.

BACKGROUND OF THE INVENTION

There are numerous applications in which staplers are used to clinch materials together by diverging and curling the legs of a staple outward and away from each other. Examples of such staplers are shown and described in U.S. Pat. Nos. 4,574,992 and 3,807,619. Referring to FIG. 1 herein, in one known application in the bedding industry, a fabric material 40 is clinched to a foam substrate 42 using a stapling process in which legs 44 of a generally U-shaped staple 46 are caused to flare or diverge and curl away from each other. The flare is accomplished with a known nose piece 20 that mounts in a known manner to a standard stapler 50, for example, a pneumatic stapler type VA0285 commercially available from Vertex Fasteners, Inc. of Skokie, Ill. The known nose piece 20 is an assembly comprised of an anvil 22 that is mounted with respect to a retaining block 24 by means of a pin 26 and a biasing element 28, for example, an anvil spring such as a compression spring. The retaining block 24 is attached to a backing plate 30 by means of fasteners 32. The anvil 22 has an angled guide or wedge 34 disposed on an anvil forward surface 27 adjacent a downstream, lower end 31 of the anvil 22. The wedge 34 has an upstream, thinner edge 52 and a downstream, thicker edge 67. The anvil spring 28 applies a biasing force against an anvil rearward surface 29 to push the thicker edge 67 of the wedge 34 against the backing plate 30.

In operation, a driver blade 36 has a proximal end mechanically connected to, and receiving a force from, an actuator 58, for example, a pneumatic cylinder, in a known manner. As shown in FIGS. 1 and 2A, an opposite, distal end 38 of the driver blade 36 contacts a crown 48 joining common ends of the two legs 44 of the staple 46. The driver blade 36 pushes the staple 46 between the backing plate 30 and the anvil 22. An upstream, thinner edge 52 of the wedge 34 has corner chamfers 54, 56; and as the staple legs 44 contact the spaced-apart chamfers 54, 56, they are deflected or guided outward and away from each other as they enter the materials being stapled. As the driver blade 36 continues to push the staple crown 48 between the backing plate 30 and the anvil 22, the staple crown 48 contacts the wedge 34. As shown in FIG. 2B, continued motion by the driver blade 36 forces the anvil 22 to compress the anvil spring 28 and move from left to right, as viewed in FIGS. 1 and 2B, along the pin 26. That motion permits the driver blade 36 to push the staple crown 48 past the wedge 34 and against the materials being fastened. The staple legs 44 continue to diverge and curl as they move through the foam substrate 42 (FIG. 1).

While the above nose piece 20 works satisfactorily in many applications, it does have disadvantages. First, many pneumatic staplers use a single acting cylinder 58 to apply the longitudinal drive forces on the driver blade 36. With a single acting cylinder 58, pressurized air from a source 60 is ported into one end 62 of the cylinder 58 and applies a force against a piston 64 mechanically connected to the driver blade 36. The pressurized air moves the piston 64 from left to right, as viewed in FIG. 1, and advances the driver blade 36 against the staple 46. As the piston advances through the cylinder, air stored in an opposite end 66 of the cylinder 58 is compressed. At the end of the staple drive stroke, that compressed air is used to return the piston 64 and retract the driver blade 36 to their respective starting positions. The return force produced by the compressed air to power the driver blade return stroke is substantially less than the force applied by the pressurized air from the source 60 during the driver blade drive stroke.

In operation, as shown in FIG. 2C, after the driver blade 36 pushes the staple 46 over a downstream, larger end 67 of the wedge 34, the driver blade 36 is then squeezed between the thicker edge 67 of the wedge and the backing plate 30 by the force of the anvil spring 28. Thus, a longitudinal force required to retract the driver blade 36 must be sufficient to overcome the side force imposed by the anvil spring 28. On occasion, the anvil spring 28 applies a side force against the driver blade 36 that is sufficient to overcome the compressed air return force, and the driver blade 36 is pinned or sticks between the spaced-apart chamfers 54, 56 and the backing plate 30.

A second disadvantage of the known nose piece 20 arises from the continuous contact between the driver blade 36 and wedge 34 as the driver blade 34 advances and retracts during a staple driving operation. Thus, the driver blade 36 and wedge 34 are parts that experience wear and, overtime, that wear can be substantial and require replacement of the anvil 22 and/or driver blade 36. Additionally, the wear can cause the degree of curl imparted to the staple to vary from the desired curl.

Therefore, there is a need for an improved nose piece 20 that is less susceptible to driver blade sticking and has less part wear.

SUMMARY OF THE INVENTION

The present invention provides a stapler with an improved nose piece that eliminates sticking of the driver blade caused by the anvil spring and therefore operates more reliably and at less cost. Further, the improved stapler nose piece of the present invention allows the driver blade to move past the anvil with minimal or no side force imposed by the anvil spring. Thus, the driver blade advances and retracts past the anvil wedge with only minimal and inconsequential frictional forces between the anvil wedge and the driver blade. Consequently, the wear on the driver blade and anvil wedge resulting from their relative motion is substantially eliminated, thereby reducing stapler maintenance and further reducing costs. In addition, with reduced anvil wear, the flaring of the legs of the staple is more consistent and repeatable over time, thereby providing a consistently high quality clinching of the materials by the staple. Therefore, the stapler of the present invention is more reliable, requires less maintenance and, over time, provides a higher quality, more efficient, and more economical stapling process. The stapler of the present invention is especially useful in clinching materials, for example, fabric and foam, that are used to make a mattress.

According to the principles of the present invention and in accordance with the described embodiments, the invention provides a stapler for clinching materials together with a generally U-shaped staple. The stapler has an anvil with spaced-apart wedges disposed adjacent a backing plate, and the wedges have respective chamfers that contact the legs of the staple and guide the legs away from each other. A biasing element provides a biasing force pushing the wedges of the anvil against the backing plate. A driver blade is movable between the spaced apart wedges and pushes against a staple crown. An actuator is mechanically connected to the driver blade and reciprocates the driver blade through advance and retract motions extending between the backing plate and the anvil. The advance motion advances the driver blade between the spaced-apart wedges, and the driver blade pushes the staple crown over the wedges while curling the staple legs of the staple away from each other. The retract motion retracts the driver blade from between the spaced-apart wedges substantially independent of the biasing force of the biasing element.

In another embodiment, the invention provides an anvil for use in a stapler and in conjunction with a driver blade for clinching materials together with a generally U-shaped staple. The anvil has spaced-apart wedges providing respective chamfers that contact legs of the staple and guide the legs away from each other.

In a further embodiment, the invention provides a driver blade for use in a stapler and in conjunction with an anvil having spaced-apart wedges for clinching materials together with a generally U-shaped staple. The driver blade has a proximal end that receives a force to move the driver blade and an opposite, distal end that is movable between the spaced-apart wedges on the anvil.

In a still further embodiment, the invention provides a nose piece for use in a stapler for clinching materials together with a generally U-shaped staple. The nose piece has an anvil with spaced apart wedges having respective chamfers that contact the legs of the staple and guide the legs away from each other and a driver blade that is movable between the spaced-apart chamfers.

In yet another embodiment, the invention provides a method of operating a stapler that clinches materials together with a generally U-shaped staple and that has the above-described nose piece.

These and other objects and advantages of the present invention will become more readily apparent during the following detailed description taken in conjunction with the drawings herein.

DETAILED DESCRIPTION OF THE INVENTION

Figure 3:
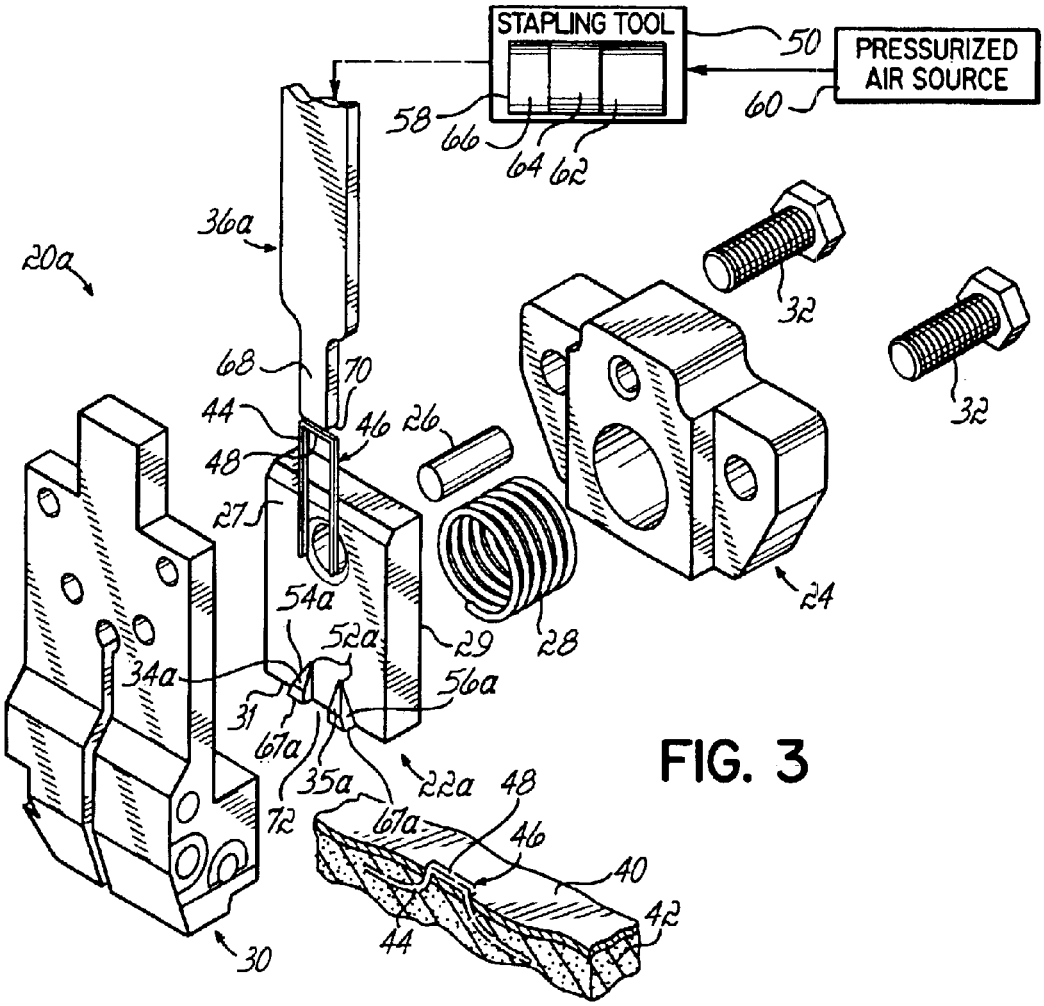
FIG. 3 is a disassembled perspective view of a nose piece for a stapler in accordance with the principles of the present invention.

Referring to FIG. 3, an improved nose piece 20*a* of the present invention is illustrated. Common numerical labels are used to identify parts in the nose piece 20*a* of FIG. 3 that are substantially identical to the previously illustrated and described parts in the nose piece 20 of FIG. 1. There are two significant differences between the nose piece 20 of FIG. 1 and the nose piece 20*a* of FIG. 3. First, nose piece 20*a* has a slot or a spacing 72 extending over the anvil forward surface 27, which forms two spaced-apart wedges 34*a*, 35*a* that have respective chamfers 54*a*, 56*a*. The slot 72 extends in a longitudinal direction with respect to the driver blade 36*a* between respective upstream, thinner edges 52*a* and respective downstream, thicker edges 67*a* of the wedges 34*a*, 35*a*, respectively. The slot 72 is normally centrally located between the wedges 34*a*, 35*a*; but, as will be appreciated, in other embodiments the slot 72 can be non-centrally located with respect to the spaced-apart wedges 34*a*, 35*a*.

Another distinctive feature of the nose piece 20*a* is that a driver blade 36*a* is sized to fit and slide between the spaced-apart wedges 34*a*, 35*a*. In this embodiment, an upper, proximal end of the driver is mechanically connected to an actuator 58, but the driver blade 36*a* is narrowed or necked down adjacent its opposite, distal end 70 to form a tongue 68 that extends longitudinally in parallel with the length of the driver blade 36*a*. The distal end 70 of the tongue 68 contacts the staple crown 48 and pushes the staple 46 between the anvil 22*a* and the backing plate 30.

The slot or a spacing 72 that extends over the anvil forward surface 27 between the two spaced-apart wedges 34*a*, 35*a* has a width slightly larger, for example, 0.010 of an inch larger, than the width of the tongue 68 of the driver blade 36*a*. Further, the depth of the slot 72 is slightly larger, for example, 0.005 of an inch larger, than the thickness of the tongue 68. Thus, the tongue 68 can slide through the slot 72 with minimal or inconsequential frictional forces being exerted on the sides of the tongue 68.

Figure 2A:
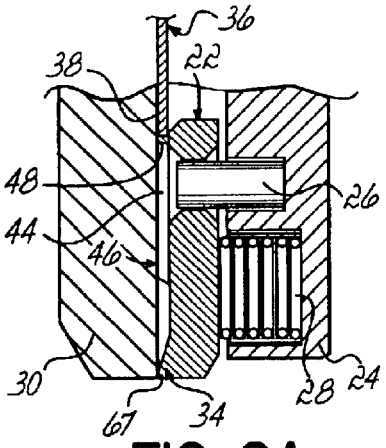
FIG. 2A PRIOR ART
FIGS. 2A–2C are partial cross-sectional side views illustrating the operation of the known nose piece of FIG. 1.
Figure 2B:
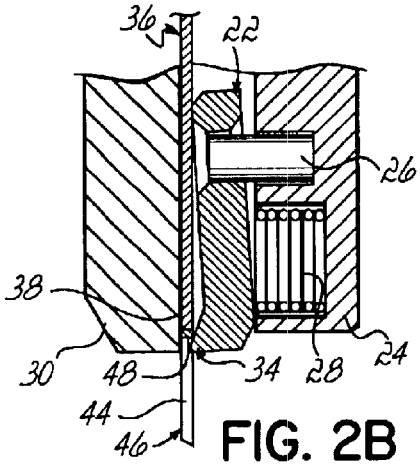
FIG. 2B PRIOR ART
Figure 2C:
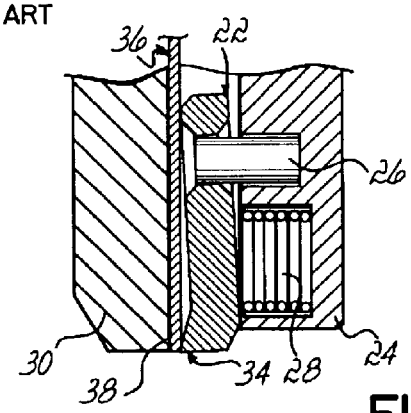
FIG. 2C PRIOR ART
Figure 5A:
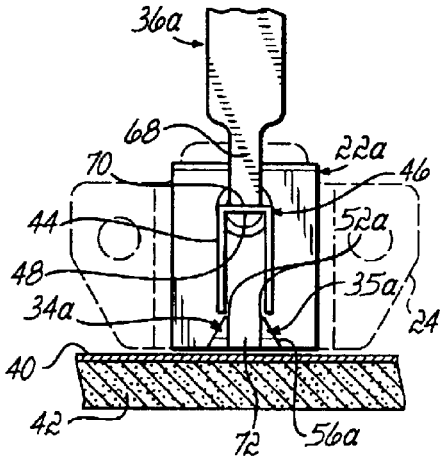
FIGS. 5A–5C are partial cross-sectional views illustrating the operation of the nose piece of FIG. 3 in clinching materials together by spreading legs of a staple away from each other.
Figure 5B:
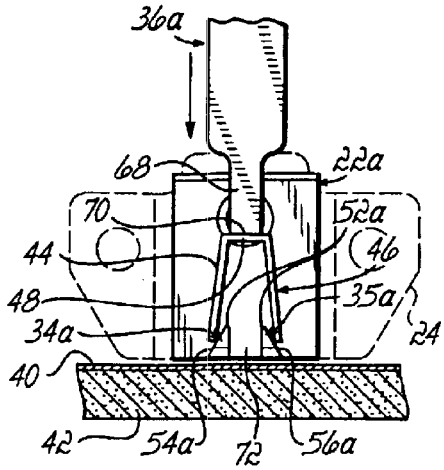
Figure 5C:
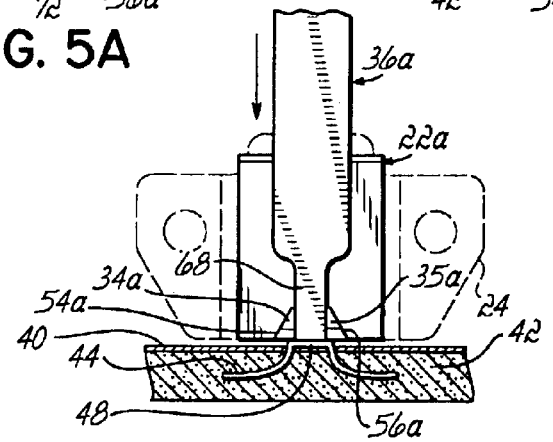

In use, in a manner identical to that described earlier, referring to FIG. 5A, the driver blade 36*a* is advanced by the actuator 58 from the normal position shown in FIG. 3, so that the driver blade distal end 70 comes into contact with the staple crown 48. As the driver blade 36*a* pushes the staple 46 downwardly between the anvil 22*a* and the blocking plate 30, as shown in FIG. 5B, the staple legs 44 contact the spaced-apart chamfers 54*a*, 56*a*; and the legs 44 are deflected or guided outward such that they diverge away from each other. In a manner identical to that previously described with respect to FIG. 2B, the distal end 70 of tongue 68 pushes the staple crown 48 past respective thinner ends 52*a* of the wedges 34*a*, 35*a*. The distal end 70 of tongue 68 then pushes the staple crown 48 over respective inclined surfaces of the wedges 34*a*, 35*a*, which compresses the anvil spring 28, and pushes the wedges 34*a*, 35*a* away from the backing plate 30. As the tongue 68 drives the staple into the materials 40, 42, as shown in FIG. 5C, the staple legs 44 diverge and curl to clinch the materials 40, 42 together.

Figure 4:
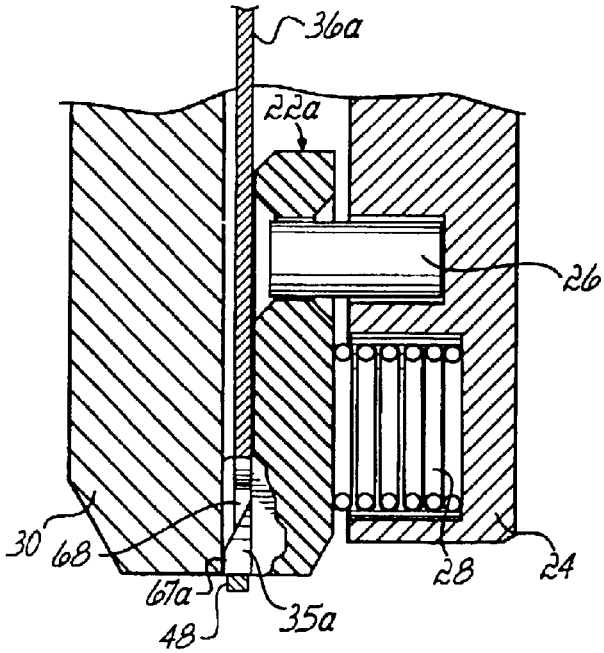
FIG. 4 is a partial cross-sectional side view illustrating the operation of the nose piece of FIG. 3.

After the staple crown 48 is pushed past respective larger ends 67*a* of the wedges 34*a*, 35*a*, as shown in FIG. 4, the anvil spring 28 pushes the anvil 22*a* and wedges 34*a*, 35*a* against the backing plate 30; however, the tongue 68 continues to slide over the anvil forward surface 27 in the slot 72 between the spaced-apart wedges 34*a*, 35*a*. The clearances in the slot 72 around the tongue 68 result in minimal or no side forces being exerted on the tongue 68 by the anvil spring 28 pushing the wedges 34*a*, 35*a* of the anvil 22*a* against the backing plate 30. The compressed air in the cylinder chamber 66 can then easily retract the driver blade 36*a* to its initial position. Further, if the stapler is actuated without any staples, as the driver blade reciprocates through its cycle, the tongue 68 readily moves through the slot 72 with only minimal or inconsequential frictional forces between the walls of the slot 72 and the tongue 68. Those minimal frictional forces are controllable depending on the manufacturing tolerances to which the slot 72 and tongue 68 are made.

Figure 1:
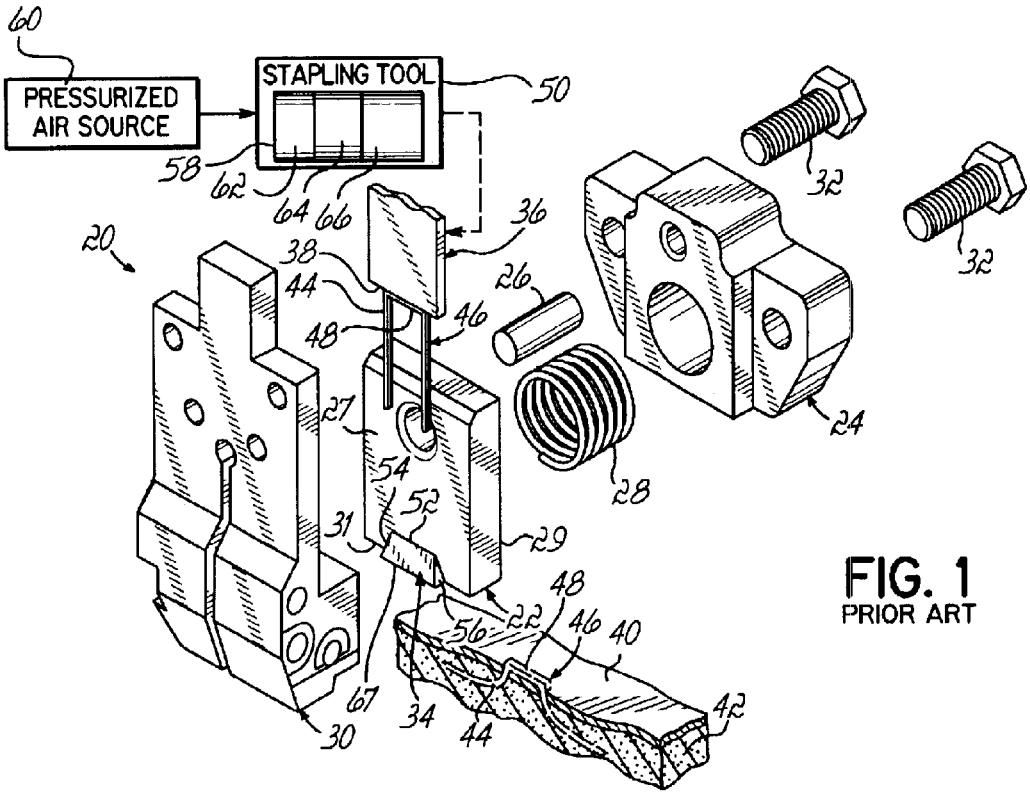
FIG. 1 PRIOR ART
FIG. 1 is a disassembled perspective view of a known nose piece for a stapler that clinches materials together by spreading legs of a staple away from each other.

The tongue 68 and slot 72 of the nose piece 20*a* of FIG. 3 provide several advantages over the nose piece 20 of FIG. 1. First, wear between the driver blade 36*a* and the wedges 34*a*, 35*a* is substantially reduced and, for all practical purposes, eliminated, thereby providing a substantially longer useful life for both the driver blade 36*a* and the anvil 22*a*. Second, with reduced anvil wear, the flaring of the staple legs 44 is more consistent and repeatable over time, thereby providing a consistently high quality clinching of the materials 40, 42 by the staple 46. Third, the side force acting on the driver blade 36*a* by the spring biased anvil wedges 34*a*, 35*a* is also, for all practical purposes, eliminated; thus, the compressed air in the cylinder chamber 66 retracts the driver blade 36*a* more reliably. Therefore, the stapler 20*a* does not stick, and it provides more reliable operation over time. Fourth, operation of the stapler in a dry mode, that is, without staples, does not exercise the anvil spring 28 and therefore, over time, provides a longer spring life. Thus, the stapler 20*a* operates more reliably, requires less maintenance, and provides a more efficient and economical stapling process in clinching materials, for example, fabric and foam, that are used to make a mattress.

While the present invention has been illustrated by a description of an embodiment, and while such embodiment has been described in considerable detail, there is no intention to restrict, or in any way limit, the scope of the appended claims to such detail. Additional advantages and modifications will readily appear to those skilled in the art. For example, in the described embodiment, driver blade 36*a* has a distal end 68 that is narrower than its opposite proximal end. As will be appreciated, in an alternative embodiment, the driver blade 36*a* can be of a constant width so long as it is able to slide between the spaced-apart wedges 34*a*, 35*a*. Further, in the described embodiment, the stapler 50 has a pneumatic actuator 58 that powers the driver blade 36 in the stapling process. As will be appreciated, in another embodiment, the actuator may be an electric motor or other powered device. In a further embodiment, the actuator may be a spring, as is often used in manual staplers. Alternatively, another mechanical force generator may also be used.

Therefore, the invention in its broadest aspects is not limited to the specific details shown and described. Consequently, departures may be made from the details described herein without departing from the spirit and scope of the claims which follow.

What is claimed is:

1. A stapler for clinching at least two materials together with a generally U-shaped staple having two legs and a crown joining common ends of the two legs, the stapler comprising:

a backing plate;

an anvil disposed adjacent the backing plate, the anvil comprising spaced-apart wedges having respective chamfers adapted to contact the legs of the staple and guide the legs away from each other, a biasing element providing a biasing force to push the spaced-apart wedges of the anvil against the backing plate;

a driver blade movable between the spaced apart wedges, the driver blade adapted to contact the crown of the staple; and an actuator connected to the driver blade and being operable to reciprocate the driver blade through advance and retract motions extending between the backing plate and the anvil, the advance motion advancing the driver blade between the spaced-apart wedges and pushing the crown of the staple over the spaced-apart wedges while curling the staple legs of the staple away from each other, and the retract motion retracting the driver blade from between the spaced-apart wedges substantially independent of the biasing force of the biasing element.

2. The stapler of claim 1 wherein the spaced-apart wedges further comprise respective upstream, thinner edges and respective downstream, thicker edges, and the driver blade being movable longitudinally between the upstream, thinner edges and the downstream, thicker edges.

3. The stapler of claim 1 wherein the spaced-apart wedges form a slot therebetween having a width slightly larger than a width of the driver blade.

4. The stapler of claim 1 wherein the spaced-apart wedges form a slot therebetween having a depth slightly larger than a thickness of the driver blade.

5. The stapler of claim 1 wherein the biasing element comprises a compression spring.

6. The stapler of claim 1 wherein the actuator comprises a pneumatic cylinder.

7. A nose piece for use in a stapler for clinching at least two materials together with a generally U-shaped staple having two legs and a crown joining common ends of the two legs, the nose piece comprising:

an anvil comprising spaced apart wedges having respective chamfers adapted to contact the legs of the staple and guide the legs away from each other; and a driver blade movable between the spaced-apart wedges.

8. A method of operating a stapler to clinch at least two materials together with a generally U-shaped staple having two legs and a crown joining common ends of the two legs, the method comprising:

providing a stapler having an actuator connected to a driver blade and being operable to reciprocate the driver blade through advance and retract motions, the driver blade having a distal end adapted to contact the crown of the staple;

advancing the staple with the distal end of the driver blade in a first direction between a backing plate and an anvil disposed adjacent the backing plate, the anvil having spaced-apart wedges being pushed into contact with the backing plate;

further advancing the staple in the first direction with the distal end of the driver blade between the backing plate and the anvil to move the legs of the staple into contact with chamfers on the spaced-apart wedges to guide the legs away from each other;

then moving the distal end of the driver blade in the first direction between the spaced-apart wedges while simultaneously advancing the crown of the staple with the distal end of the driver blade between the spaced-apart wedges and the backing plate to compress the biasing element and move the anvil away from the backing plate;

further advancing the crown of the staple with the distal end of the driver blade in the first direction past a downstream, thicker end of the wedge; and allowing the biasing element to move the spaced-apart wedges on the anvil back into contact with the backing plate, while the distal end of the driver blade remains between the spaced-apart wedges.

9. The method of operating a stapler of claim 7 further comprising moving the distal end of the driver blade in an opposite direction from between the spaced-apart wedges independent of a biasing force from the biasing element.

* * * * *